US005468190A

United States Patent [19]

McCaffrey

[11] Patent Number: 5,468,190

[45] Date of Patent: Nov. 21, 1995

[54] MULTI-PURPOSE ARENA

[75] Inventor: Felim McCaffrey, Toronto, Canada

[73] Assignee: Hatch Associates Ltd., Mississauga

[21] Appl. No.: 46,851

[22] Filed: Apr. 16, 1993

[51] Int. Cl.[6] ..... E04B 9/00

[52] U.S. Cl. ..... 472/82; 472/92; 52/7; 52/126.5

[58] Field of Search ..... 472/92, 93, 94, 472/81, 82; 52/7, 126.5, 126.6, 64

[56] References Cited

U.S. PATENT DOCUMENTS

| | | | |
|---|---|---|---|
| 3,399,887 | 9/1968 | Altier | 52/7 |
| 4,735,024 | 4/1988 | Rosato et al. | 52/126.6 |
| 4,907,793 | 3/1990 | Wund | 472/92 |
| 4,912,890 | 4/1990 | Hoyeck | 52/126.5 |
| 4,937,896 | 7/1990 | Niimura | 52/126.5 |
| 5,103,600 | 4/1992 | Geiger et al. | 52/7 |

*Primary Examiner*—Lanna Mai

*Attorney, Agent, or Firm*—Ridout & Maybee

[57] ABSTRACT

A multipurpose arena has a platform providing a performing, playing or exhibition area which can be raised or lowered to allow for different configurations of banked seating. The raising and lowering is achieved by displacement of air in or out of an air vessel formed beneath the platform, either by a hull floating in a well which can be emptied of water by air pressure or scuttled, or by a skirt depending from the platform and sealed to underlying structure. If a skirt is used, space can be reclaimed within a structure inside the skirt which provides a reaction surface for the air pressure. The skirt may be sealed to the underlying structure by a water seal in a trough, or by sealing the lower edge of a telescoping skirt to the structure.

11 Claims, 3 Drawing Sheets

MULTI-PURPOSE ARENA

BACKGROUND OF THE INVENTION

1. Field of the Invention

This invention relates to arenas utilized for spectator sports and other events, and more particularly to arenas intended to be used for more than one purpose.

2. Review of the Art

In one known arrangement of such an arena, similar to that described in U.S. Pat. No. 4,735,024, the ice area of a hockey arena is carried by a platform supported by multiple screw jacks so that it may be lowered from a first level at which it is used for playing hockey to a second level at which marginal portions of the platform may carry additional banked seating, below existing banked seating surrounding the platform, thus providing a reduced playing area and additional close-in seating for a game such as basketball. The additional seating may be withdrawn below the existing seating to enable the platform to be raised.

Such an arrangement has been successfully implemented and is highly desirable from the point of view of improving the utility of an arena in which it is incorporated. The necessary screw jacks and their associated computerised control system are however complicated and expensive to install and maintain, and the platform structure is also complex in order to provide recesses for accommodating the jacks. The distance through which the platform may be lowered is also limited in existing installations.

SUMMARY OF THE INVENTION

It is an object of the present invention to implement a similar arrangement utilizing a simpler and more easily controlled means for raising and lowering the platform, which does not require a complex or unusually rigid platform structure.

In an arena for spectator events which comprises a platform, first banked seating arranged around the platform, means for raising and lowering the platform between a first raised position adjacent the first banked seating and a second lowered position, and second banked seating insertable onto a peripheral portion of the platform beneath and within the first banked seating when the platform is in its lowered position, the invention is the improvement wherein the means for raising and lowering the platform comprises an air vessel disposed beneath and secured to the platform, the air vessel having a horizontal cross-section comparable to that of platform, and an upward facing reaction surface forming a lower boundary of an air space defined within the vessel is provided at least when the platform is above its lowered position, together with means for introducing air into the air space to lift said platform, and means for displacing air from the air space to lower said platform.

In a first embodiment, the air vessel is submerged in a tank filled with water and may either be integral with the platform or connected to the underside of the platform by struts. This arrangement is bulky, since the reaction surface is formed by the water, and the tank must be large enough to accommodate both the vertical movement of the vessel, and the depth of the vessel, which must have a hull or skirt deep enough to allow sufficient air pressure to be developed within it to lift the platform without air escaping beneath the skirt. In a somewhat more compact arrangement, a top of the air vessel is formed at an underside of the platform, and additionally, fixed structure may be located within the vessel provided that it does not obstruct the platform from reaching its lowered position. In a limiting case, the tank becomes merely an annular water seal coacting with the skirt of the vessel, the water in the seal inside and outside of the skirt acting as a manometer to maintain a desired pressure within the vessel. A still more compact arrangement can be achieved by use of a vertically telescoping skirt, in which case the water seal may be eliminated.

Means will normally be required for stabilizing the platform against tilting and horizontal movement when supported by air pressure.

Further features of the invention will be apparent from the following description.

SHORT DESCRIPTION OF THE DRAWINGS In the drawings

DESCRIPTION OF THE PREFERRED EMBODIMENTS

Figure 1:
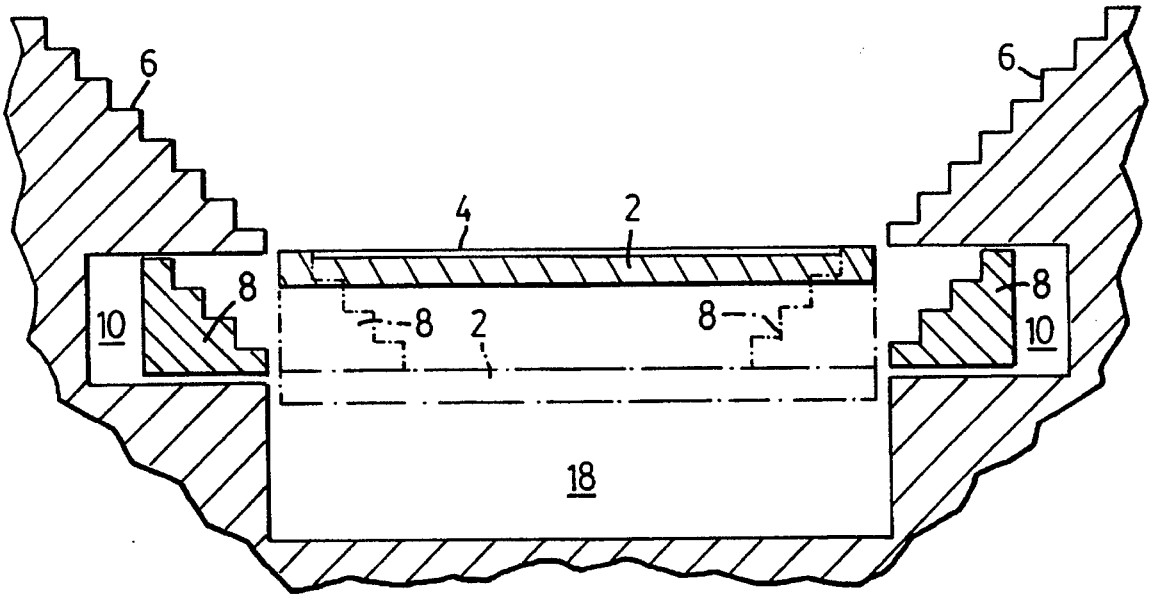
FIG. 1 is a schematic cross-section through an arena, indicating the environment in which the invention is implemented.

FIG. 1 illustrates the environment in which the invention is implemented. A platform 2 provides a performance, playing or display area, in this example formed by a layer of ice 4. The platform contains suitably installed refrigerant coils for freezing the ice which are not shown and form no part of the invention. These coils, the layer in which they are embedded, and the ice all contribute to the total loaded weight of the platform which in typical cases may amount to about 150–200 pounds per square foot. Assuming a typical platform area of about 20,000 square feet, the total mass of the platform may be of the order of 3 to 4 million pounds.

In a first raised position, the platform is surrounded by banks of spectator seating 6, and the total platform area is available for use, for example for playing hockey. In a second, lowered position shown in broken lines, additional banks 8 of seating may be moved onto the platform 2 as shown in broken lines to provide further seating below and inward of the banks 8. Although the banks 8 are shown as retracted into recesses 10 when the platform is raised, other arrangements may be used—for example they may be towed into position through an entrance (not shown) either before or after the platform is lowered. Handling of the additional seating banks 8 does not form part of the invention, which differs from the prior art as exemplified by U.S. Pat. No. 4,735,054 in the means used to raise, lower and support the platform. The remaining Figures of the drawings are thus solely concerned with such means, accommodated in a zone such as a well 18 beneath the platform.

Figure 2:
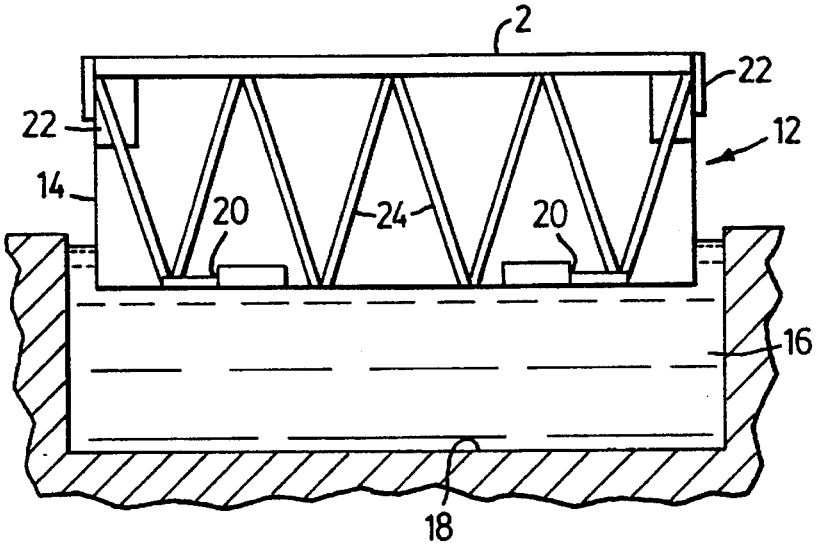
FIG. 2 is a fragmentary schematic cross-section through the platform and the volume beneath it, showing a first embodiment of the invention.

Referring to FIG. 2, the platform 2 forms the deck of a barge or pontoon 12 whose hull or tank 14 floats in water 16 contained in the well 18 formed beneath the platform. To lower the platform, the barge may simply be scuttled by opening large valves 20 in the bottom of the hull, permitting water to flow into the hull, with air escaping through paths provided by fan assemblies 22, when the latter are inoperative until the hull rests on the bottom of the well 18.

To raise the platform the fan assemblies 22 are operated to blow air into the interior of the hull, thus expelling water through the valves 20, until the hull is emptied of water and the valves 20 can be closed. At this point the hull is floating on the water in the position shown in FIG. 2. With a platform having a loaded weight per unit area as described above, an air pressure of no more than about 1.5 pounds per square inch above atmospheric is all that is required to lift the platform and hull, and this pressure can readily be provided by conventional blower fans. The uniform support of the platform provided by the air pressure minimizes the flexural strength required in the platform, although it must be stiff enough to resist upward bowing caused by over pressure within the hull. By integrating the structure of the platform 2 with that of the hull 14 adequate strength may be obtained with economy of material. Internal bulkheads or crossbracing, shown schematically by the numeral 24 may also be provided. The platform is located in its raised position by stops (not shown) against which it is held by the air pressure within the hull.

Figure 3:
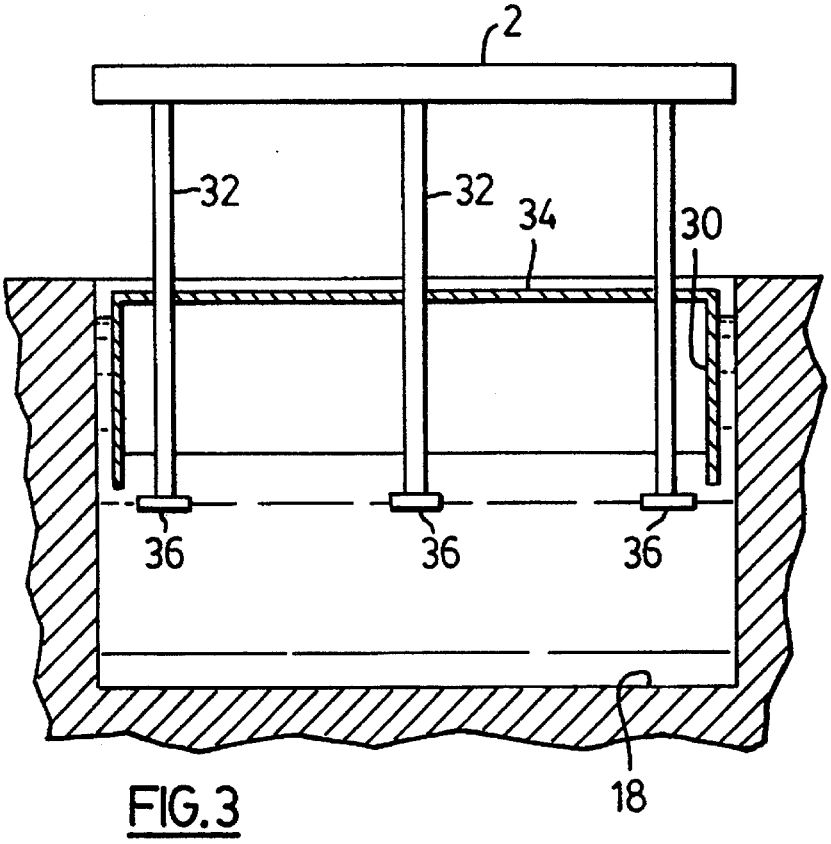
FIG. 3 is a corresponding fragmentary schematic cross-section of a second embodiment of the invention.

In some instances, it may be necessary to position the well 18 at a lower level, or to separate the structure of the platform 2 from that of the hull 14. It is also possible to omit the bottom of the hull, leaving only a skirt 30. These possibilities are illustrated in FIG. 3, where the platform 2 is supported by columns 32 above a deck 34 of the hull. The columns 34 pass through the deck to feet 36 which support the platform in its lowered position so that heavy loads do not have to be passed through the deck 34 and skirt 30. The valves 20 are not required, and the fans 22 are not shown although they are installed and operated similarly to those described with reference to FIG. 2.

Disadvantages of the arrangement of FIG. 2 as shown are its greater complication, the greater amount of space occupied beneath the platform, and the higher air pressure required to lift the deck (and thus the platform) from a submerged position at the bottom of the well. Even the well 18 of the embodiment of FIG. 1 may occupy an excessive amount of valuable space on some sites. The embodiment of FIG. 4 enables much of the space occupied by the well 18 in FIG. 2 to be reclaimed. Instead of using water as a primary reaction surface against which lifting forces are developed, an upper wall 40 of a hollow structure such as a car park serves that purpose, a skirt 42 depending from the edges of the platform 2 depending into a water seal housed in a narrow trough 44 around a perimeter of the structure. The water 16 in the trough acts in the manner of a manometer to maintain an airtight water seal with the skirt 42. In its lowered position, the platform 2 may be supported directly of the wall 40, whilst in its raised position it is supported by the air pressure developed by the fan assemblies 22.

Figure 5:
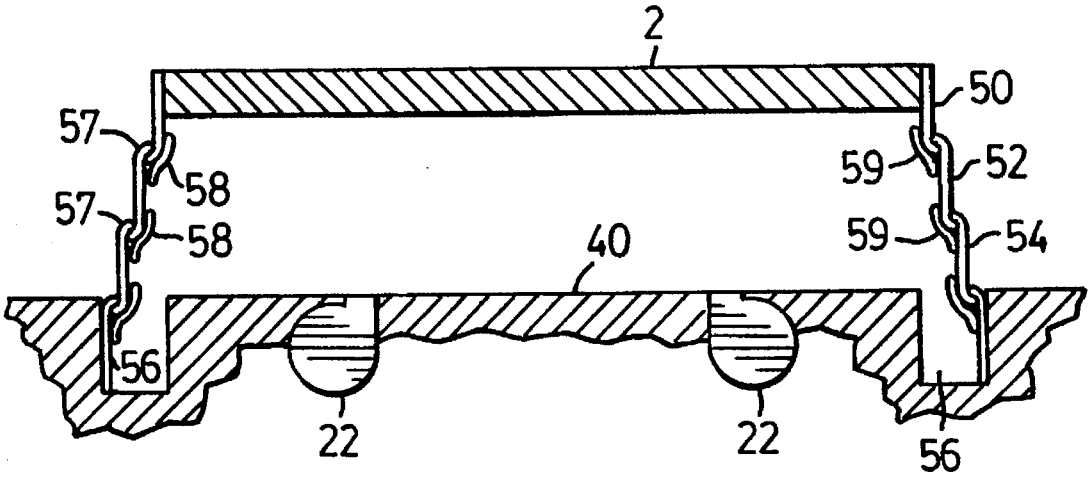
FIG. 5 is a corresponding fragmentary schematic cross-section of a fourth embodiment of the invention.

In order to avoid the inconvenience of a deep trough 44, the skirt 42 may be replaced as shown in FIG. 5 by a telescoping skirt of concentric walls 50, 52, 54 which collapse into a shallow trough 56 as the platform 2 is lowered. Simple flexible flap seals 58 may be provided between the walls which will be maintained in sealing condition by internal air pressure. The fan assemblies 22 may be located in this and the preceding embodiment beneath the wall 40. It may be preferable for the walls 50, 52 and 54 to be arranged beneath the edge of the platform 2, and with the lowest wall 54 innermost. This embodiment does not require a water seal. The walls are suspended from one another by top and bottom lips 57 and 59.

Figure 4:
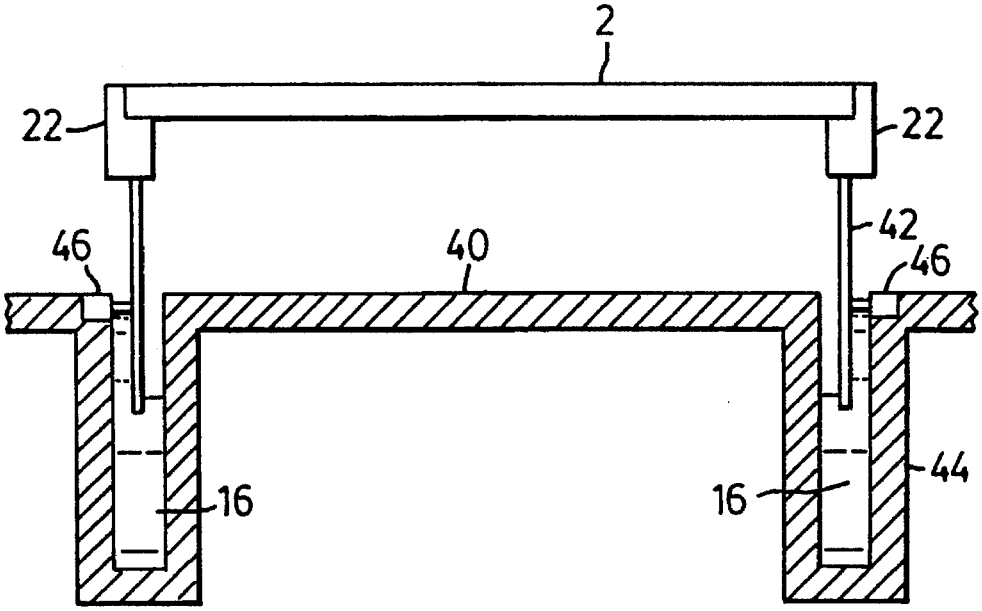
FIG. 4 is a corresponding fragmentary schematic cross-section of a third embodiment of the invention.

Particularly in the embodiments of FIGS. 3–5, it will usually be necessary to ensure that the platform does not tilt during raising or lowering, and also to ensure that the platform does not move laterally during use when supported on air. These requirements may be met by various techniques, readily apparent to those skilled in the art, and only exemplary means are shown. Thus in FIG. 4, rams 46 may be used to provide lateral stabilization.

Figure 6:
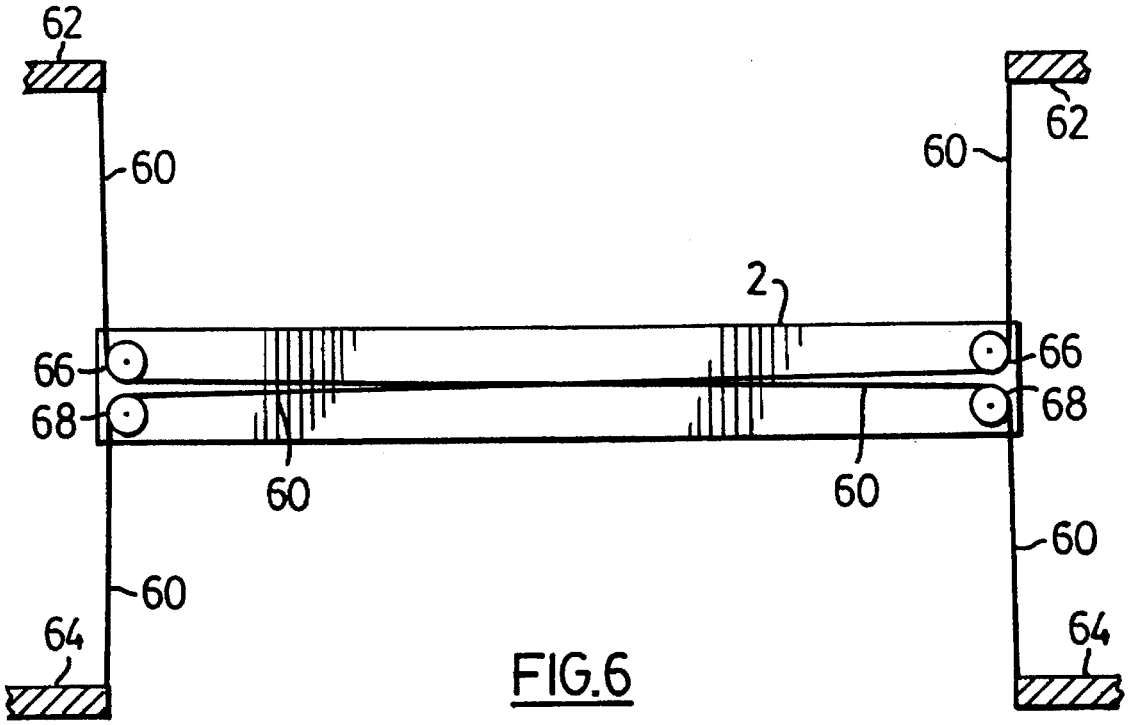
FIG. 6 is a fragmentary schematic cross-section of the platform illustrating one means of stabilizing the latter.

FIG. 6 show a technique which may be utilized to stabilize the platform 2 against tipping. Pairs of tensioned wire cables 60 (only one pair is shown) extend between anchorages 62 and 64 respectively above the raised and below the lowered position of the platform and on opposite sides of the platform, the cables passing over sheaves 66 and 68 on opposite sides of the platform, thus preventing tipping about an axis perpendicular to the plane of the cables. Such an arrangement may be provided on each side of the platform.

I claim:

1. In an arena for spectator events which comprises a platform on which events may be presented, first banked seating arranged around the platform, means for raising and lowering the platform between a first raised position adjacent the first banked seating and a second lowered position, and second banked seating insertable onto a peripheral portion of the platform beneath and within the first banked seating when the platform is in said second lowered position, the improvement wherein the means for raising and lowering the platform comprises an air vessel disposed beneath and secured to the platform, the air vessel providing an enclosed air space having a horizontal cross-sectional area substantially coextensive with the platform, and an upward facing reaction surface forming a lower boundary of said air space is provided at least when the platform is above its lowered position, together with means providing a seal between the vessel and the reaction surface, means for introducing air into the air space to lift said platform, and means for displacing air from the air space to lower said platform.

2. An arena according to claim 1, further including structure for stabilizing the platform against movement in a horizontal plane at least when in said first raised position.

3. An arena according to claim 1, further including devices for stabilizing the platform against tipping during movement between said first raised and said second lowered positions.

4. An arena according to claim 1, wherein the air vessel is formed beneath the platform by a skirt depending from the platform.

5. An arena according to claim 4, wherein the skirt depends into a trough surrounding said upward facing reaction surface.

6. An arena according to claim 5, wherein the upward facing reaction surface surrounded by the trough is an upper surface of a hollow structure.

7. An arena according to claim 5, wherein the skirt depends into a water seal in the trough.

8. An arena for spectator events which comprises a platform on which events may be presented; banked seating arranged around the platform; and means for raising and lowering the platform relative to the seating between a first raised position and a second lowered position, said means for raising and lowering the platform comprising a peripheral skirt depending from a periphery of the platform to define an enclosed air space having a horizontal cross-sectional area substantially coextensive with the platform, an upward facing reaction surface beneath the platform and forming a lower boundary of said air space, means providing an air seal between the skirt and the reaction surface, means for introducing air into the air space to lift said platform, and means for releasing air from the air space to lower said platform.

9. An arena according to claim 8, wherein the means for introducing air comprises at least one fan.

10. An arena according to claim 8, wherein the seal is a water seal.

11. An arena according to claim 8, wherein the skirt is a vertically telescoping skirt.

* * * * *